US007118252B2

(12) United States Patent
Jung

(10) Patent No.: US 7,118,252 B2
(45) Date of Patent: Oct. 10, 2006

(54) LIGHTED SIGN FIXTURE HAVING REFLECTIVE SURFACE

(76) Inventor: Hae-Ryong Jung, 2111 Jefferson Davis Hwy. - Suite 119N, Arlington, VA (US) 22202

( * ) Notice: Subject to any disclaimer, the term of this patent is extended or adjusted under 35 U.S.C. 154(b) by 94 days.

(21) Appl. No.: 11/032,132

(22) Filed: Jan. 11, 2005

(65) Prior Publication Data

US 2005/0259413 A1 Nov. 24, 2005

Related U.S. Application Data

(60) Provisional application No. 60/542,877, filed on May 19, 2004.

(51) Int. Cl.
*F21V 17/02* (2006.01)

(52) U.S. Cl. ..... 362/320; 362/217; 362/296

(58) Field of Classification Search ..... 362/296, 362/320, 217

See application file for complete search history.

(56) References Cited

U.S. PATENT DOCUMENTS

| | | | | |
|---|---|---|---|---|
| 871,510 | A | 11/1907 | Kerr | |
| 2,175,072 | A | 10/1939 | Wompey | |
| 2,269,718 | A | 1/1942 | Huber | |
| 2,341,658 | A | 2/1944 | Salani | |
| 2,689,422 | A | 9/1954 | Hoff | |
| 3,654,471 | A * | 4/1972 | Nilsson | 250/505.1 |
| 4,383,382 | A | 5/1983 | Hegarty | |
| 4,642,741 | A | 2/1987 | Cohn | |
| 4,683,525 | A | 7/1987 | Camm | |
| 4,719,546 | A * | 1/1988 | Spitz | 362/260 |
| 4,794,503 | A | 12/1988 | Wooten et al. | |
| 4,799,134 | A * | 1/1989 | Pinch et al. | 362/217 |
| 4,864,475 | A | 9/1989 | Jung | |
| 4,991,070 | A | 2/1991 | Stob | |
| 5,075,827 | A | 12/1991 | Smith | |
| 5,192,129 | A | 3/1993 | Figueroa | |
| 5,235,499 | A | 8/1993 | Bertenshaw | |
| 5,509,223 | A | 4/1996 | Jung | |
| 5,884,993 | A * | 3/1999 | Conn | 362/217 |

* cited by examiner

*Primary Examiner*—Ali Alavi

(57) ABSTRACT

The subject lighting system (1) generally comprises a fixture body assembly (10); a face assembly (5) coupled to the fixture body assembly (10) to extend at least partially over a channel (15) defined thereby; a flexible reflective member (20) disposed in the channel (15) formed by the fixture body assembly (10) to define a reflective surface; and, a light source (60) disposed adjacent a base portion of the reflective surface. The fixture body assembly (10) includes a longitudinally extended inside base surface (14) and at least a pair of laterally opposed inner side surfaces (13) transversely oriented relative to the inside base surface (14), such that the inner side and inside base surfaces define the longitudinally extended channel (15). The face assembly (5) extends at least partially over the channel (15), and includes a light transmissive portion (72). The reflective member (20) is defectively retained by the face and fixture body assemblies (5, 10) to define a reflective surface concavely arcuate in sectional contour, with the base portion of its reflective surface being supported by the fixture body assembly's inside base surface (14). The light emitted by the light source (60) in this system (1) is directed in a substantially wide angle illumination pattern through the light transmissive portion (72) of the face assembly (5).

20 Claims, 2 Drawing Sheets

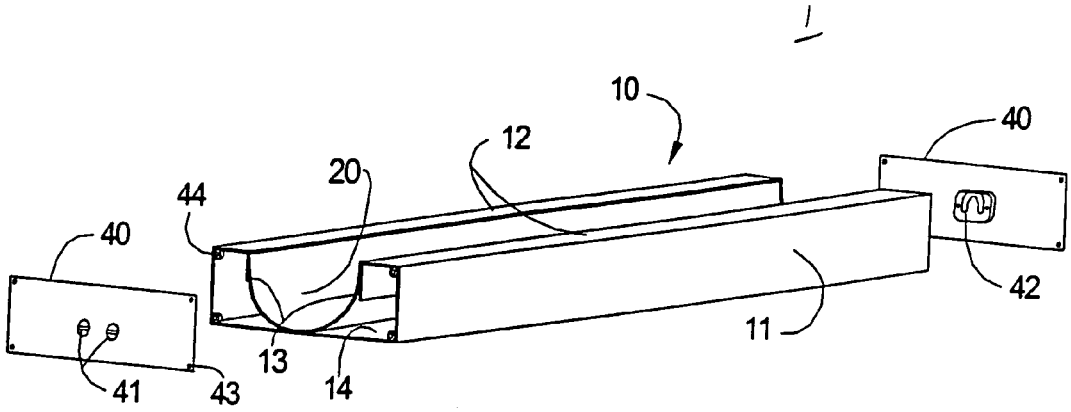
Fig. 3
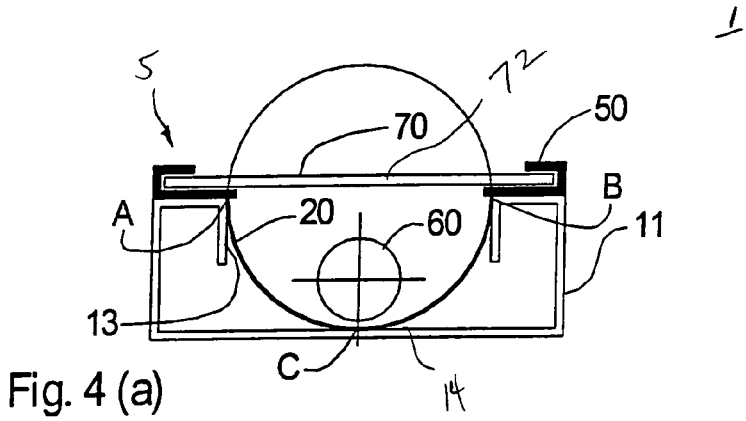
Fig. 4 (a)
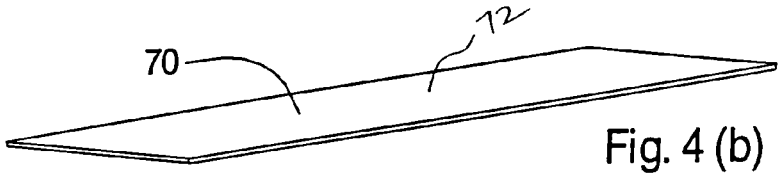
Fig. 4 (b)
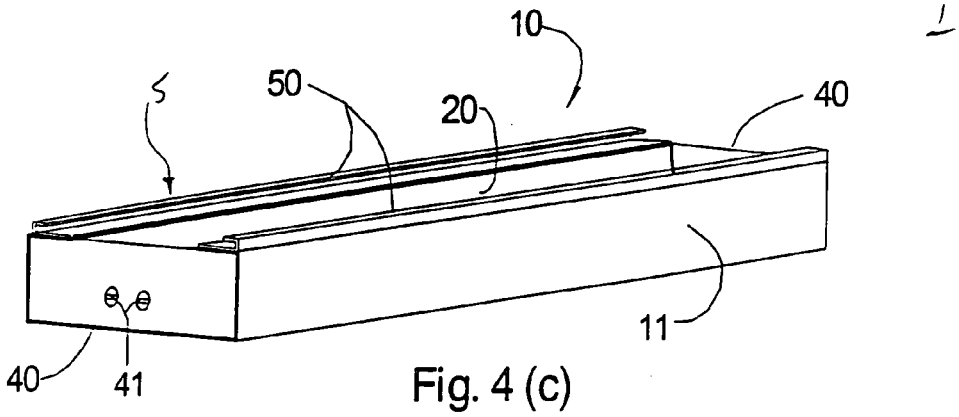
Fig. 4 (c)
Fig. 4

LIGHTED SIGN FIXTURE HAVING REFLECTIVE SURFACE

RELATED U.S. APPLICATION DATA

This Application is based on U.S. Provisional Patent Application, Ser. No. 60/542,877, filed on May 19, 2004.

BACKGROUND OF THE INVENTION

1. Field of the Invention

The subject lighted sign fixture having reflective surface is generally directed to a lighting system capable of visually presenting a bright, visually crisp, and contrasting wide angle illumination pattern through a light transmissive portion of a given sign. More specifically, the lighted sign fixture is one whose simple structure permits easy and convenient fabrication while maintaining a quadratic curvature in its reflective surface. The lighted sign for the fixture provides a simple retentive structure for maintaining a flexible reflective member in this manner.

2. Prior Art

Lamp lighting systems are known in the art, as are lighted sign fixtures having reflective surfaces. One such lighting system is disclosed in U.S. Pat. No. 5,509,223, issued Apr. 23, 1996 to Applicant. The lighting system disclosed in that Patent is highly effective in providing a substantially constant illumination density for a brightly visible emission of light through a sign member. For ease and economy of manufacture, as well as for optimum reconfigurability and serviceability in the field, there is still a need for a simpler lighting fixture which provides such structural advantages while preserving the brightness of sign illumination.

A proper contour must be preserved for the lamp system's reflective surface if the proper illumination effect is to be generated and consistently maintained. In known lighting systems, the reflective member is formed of a material pre-formed with the required surface contour. Alternatively, the reflective surface is formed by a coating or other laminate applied to a rigid backing having such pre-formed contour. The need to pre-form and/or pre-assemble the reflective surface contour in each of these cases not only burdens manufacturability and cost, but the fixed nature of the structural components impedes the ready maintenance and repair of such lighting fixture.

Hence, there remains a need in the art for a lighting system wherein the arcuate reflective surface contour required for a given application may be conveniently and quickly realized, even without the need for pre-shaping, pre-forming, or pre-assembly of reflective surface components.

SUMMARY OF THE INVENTION

It is, therefore, an object of the present invention to provide a lighting system capable of generating a brightly, visually crisp and highly contrasting visible emission of light through a sign member.

It is another object of the present invention to provide a lighting system where an arcuate reflective surface contour is conveniently and quickly realized in a simple and easily manufactured fixture.

These and other objects are attained in a lighting system formed in accordance with the present invention. The subject lighting system generally includes a fixture body assembly having a face assembly coupled to the fixture body assembly to extend at least partially over a channel defined thereby. A flexible reflective member is disposed in the channel formed by the fixture body assembly to define a reflective surface, and, a light source is disposed adjacent a base portion of the reflective surface. The fixture body assembly includes a longitudinally extended inside base surface and at least a pair of laterally opposed inner side surfaces transversely oriented relative to the inside base surface such that the inner side and inside base surfaces define the longitudinally extended channel. The face assembly extends at least partially over the channel, and includes a light transmissive portion. The reflective member is deflectively retained by the face and fixture body assemblies to define a reflective surface concavely arcuate in sectional contour, with the base portion of its reflective surface being supported by the fixture body assembly's inside base surface. The light emitted by the light source in this system is directed in a substantially wide angle illumination pattern through the light transmissive portion of the face assembly.

BRIEF DESCRIPTION OF THE DRAWINGS

FIG. 3 is an exploded perspective view of the fixture body assembly with the flexible reflective member disposed therein, illustrating the attachment of end plate members, in accordance with the exemplary embodiment of the present invention;

FIG. 4(*a*) is a schematic sectional view of a lighting system assembled in accordance with the exemplary embodiment of the present invention;

FIG. 4(*b*) is a perspective view of a face panel member formed in accordance with the exemplary embodiment of the present invention; and, FIG. 4(*c*) is a perspective view of the lighting system assembled in accordance with the exemplary embodiment of the present invention, shown with the face panel member of FIG. 4(*b*) removed.

DETAILED DESCRIPTION OF THE PREFERRED EMBODIMENTS

Figure 1:
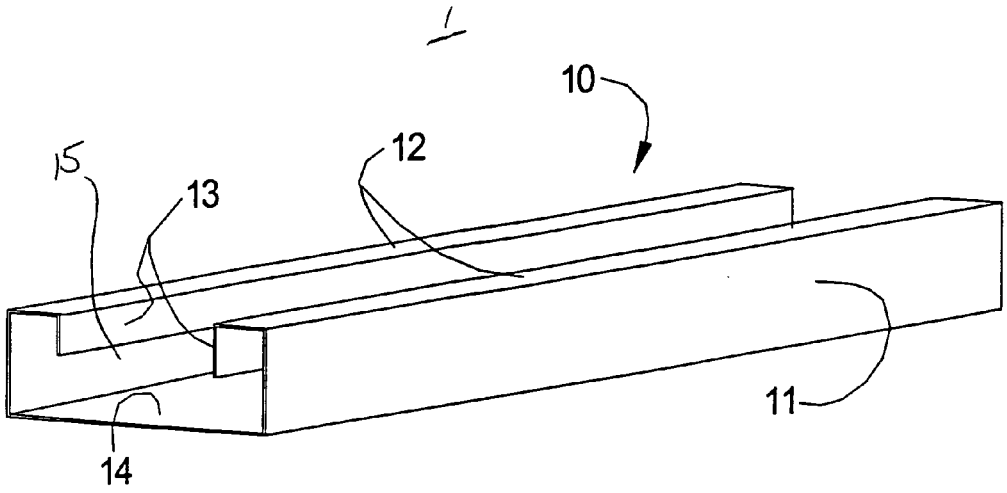
FIG. 1 is a perspective view of a fixture body assembly in one exemplary embodiment of the present invention.
Figure 2:
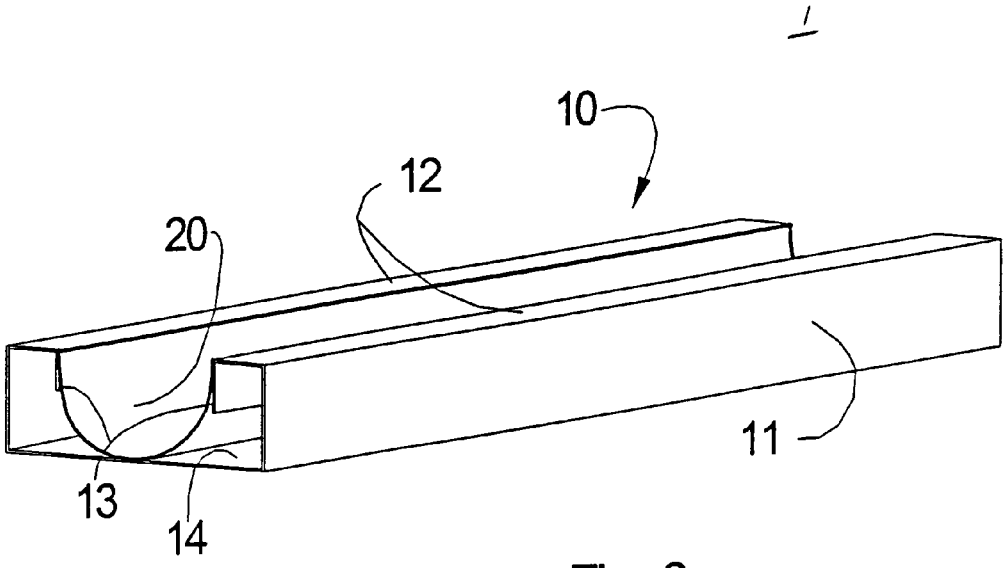
FIG. 2 is a perspective view of the fixture body assembly shown with a flexible reflective member disposed therein, in accordance with the exemplary embodiment of the present invention.

Referring now to FIGS. 1–4(*c*), there is illustrated a lighting system 1 formed in accordance with an exemplary embodiment of the present invention. In this exemplary embodiment, lighting system 1 generally includes a fixture body assembly 10 and a face assembly 5 (shown in FIG. 4*a*) coupled thereto. Fixture body and face assemblies 10, 5 together house a light source 60 and retain a flexible reflective member 20 at a predetermined arcuate configuration thereabout. In accordance with one aspect of the present invention, flexible reflective member 20 need not itself be pre-shaped or otherwise pre-configured with the predetermined curvature in its reflective surface contour necessary for generating the desired illumination effect. Flexible reflective member 20 need only be of sufficient flexibility to form the necessary curvature when it is slid or otherwise inserted within fixture body assembly 10.

The retaining structure defined by fixture body assembly 10, preferably in combination with face assembly 5, serve to deflect flexible reflective member 20 in the degree required for proper shaping of its reflective surface. The predetermined curvature is thus imparted to flexible reflective member 20 by virtue of its retention within fixture body assembly 10, when lighting system 1 is fully assembled.

As shown in the isolated perspective view of FIG. 1, fixture body assembly 10 is integrally formed in the exemplary embodiment disclosed with an inside bottom, or base, surface 14 from which a pair of outside surface-forming side walls 11 extend transversely upward. A top surface 12 laterally extends from the upper periphery of each side wall 11 to form a shelf- or shoulder-like portion. A pair of inner side surfaces 13 then extend respectively downward from the inner lateral peripheries of these top surfaces 12 to define—along with the inside base surface 14, a longitudinally extended channel 15. Extended channel 15 receives therein both flexible reflective member 20 and light source 60.

Inner side surfaces 13 and inside base surface 14 cooperatively define channel 15. Their relative configurations in terms of position, orientation, contour, dimension, and the like—then determine the corresponding configuration of channel 15. Hence, the relative configurations of these surfaces 13, 14 effectively define the contour realized for the flexible reflective member's reflective surface. In the exemplary embodiment shown, for instance, the relative configurations of inner side surfaces 13 and base surface 14 are such that while the given flexible reflective member 20 extends longitudinally within channel 15, it is deflected to maintain a substantially semi-circular, parabolic, or other such continuously concave contour therealong. When a longitudinally extended tubular lamp 60 is disposed adjacent the intermediate base of the resulting reflective surface concavity, then, the light generated by lamp 60 is effectively directed from lighting system 1 in a substantially wide angle illumination pattern, much in the manner disclosed in U.S. Pat. No. 5,509,223.

Preferably, fixture body assembly 10 is formed of a sheet metal or other such material of comparable properties known in the art. The material is preferably of sufficiently suitable strength, rigidity, and durability for the intended application. In addition, the material is preferably of such thickness that it may be bent to delineate the various portions 11–14, without undue compromise of its structural integrity.

Examples of such materials for fixture body assembly 10 include sheet aluminum having a thickness of approximately 1 mm to be sufficiently malleable to the desired shape yet sufficiently strong and rigid to thereafter maintain the shaped form. Other examples include cold rolled steel having a thickness of approximately 0.4 mm to similarly provide a combination of material properties sufficient for the intended application. Depending on such factors as anticipated environmental conditions during use, expected service life, and availability of manufacturing resources, various other materials of various suitable thicknesses may be used in accordance with the present invention.

The selected sheet-like metal material employed in the embodiment shown is formed by a roll forming or other suitable metal processing technique known in the art. The exposed outer surfaces of fixture body assembly 10 are preferably either finished, or finished with an electrostatic, powder, or other such coating, the particular choice of finish not being important to the present invention.

In the embodiment shown, the properties and dimensions of flexible reflective member 20 are such that it may realize the deflection necessary for its reflective surface to describe the predetermined concavity, even with only certain of its portions actually bearing against fixture body assembly 10. Typically, member 20 may be adequately supported by the surface portions 13 and 14 retentively engaging just the flexible reflective member's lateral edge and central portions. It is normally not necessary for the laterally opposed inner side surfaces 13, to extend fully downward to inside base surface 14, unless the mechanical properties of the material employed, or other such factors prevailing in the given application, require as much for sufficient structural stability, strength, and the like. This yields savings not only in terms weight and material consumption, but also in terms of requisite fabrication time and effort.

Thus, inner side surfaces 13 preferably extend from respective top surfaces 12 towards inside bottom surface 14 only partially downward. Side surfaces 13 extend downwardly to provide stable support for the flexible reflective member's lateral edges portions. Preferably, each inner side surface 13 also extends sufficiently downward that the likelihood of a given lateral edge portion of flexible reflective member 20 sliding out of engagement therewith is minimized, if not altogether eliminated.

Flexible reflective member 20 may be formed of any suitable material known in the art to provide at least one mirror grade reflective surface. The actual choice of material composition and structural configuration for flexible reflective member 20 is not important to the inventive concept, so long as member 20 is found to be sufficiently deflectable by the surrounding structure to attain the predetermined continuously arcuate reflective surface contour required for the intended application.

In an exemplary embodiment, a silver or aluminum vapor deposited polyester film, such as silver mylar, formed by vacuum coating or other processes known in the art may be suitably employed for reflective member 20. In another example, flexible reflective member 20 may be formed of an aluminum or other such suitable sheet metal material having a thickness of approximately 0.007–0.010 inch. A mirror grade anodized thin metallic aluminum sheet material formed by pressing or rolling is one example of such materials. Other examples of suitable materials for reflective member 20 include a polycarbonate film having a reflective coating formed by silver or aluminum deposition, or other processes known in the art.

Flexible reflective member 20 is positioned within channel 15 to form, for example, a reflective concave surface having a substantially semi-circular sectional contour describing a predetermined diameter. Given an example wherein the reflective surface describes a diameter of approximately 4.5 inches, a corresponding width dimension is defined between points A and B (FIG. 4(*a*)), and a depth dimension of about 2.25 inches is defined from the top surfaces 12 to the inside base surface 14 of fixture body assembly 10. In that example, a silver or aluminum vapor deposited polyester film, such as silver mylar, of approximately 0.014 inch in thickness may be employed to obtain such substantially-circular reflective surface about tubular light source 60.

A suitable light source 60 in such exemplary configuration may be, for instance, a T-12 type lamp having a diameter of approximately 1.5 inches. Where a lamp of another type and/or configuration is employed, it may be preferable to suitably adapt certain dimensions accordingly. For example, where a T-10 type lamp having a diameter of approximately 1.0 inch is employed, a reflective surface diameter of approximately 3.0 inches and a depth dimension of about 1.5 inches from the top surfaces 12 to the inside base surface 14 of fixture body assembly 10 may be preferable. Such dimensional variations may be suitably made in accordance with the present invention, depending on the particular requirements of the intended application.

In accordance with the present invention, flexible reflective member 20, in its undeflected state, simply forms a flat, substantially planar sheet structure. No pre-forming, pre-shaping, or pre-mounting to a shaped backing, or other such extraneous steps are necessary prior to assembly of lighting system 1. Rather, flexible reflective member 20 is deflected to semi-rolled configuration and either slid longitudinally into channel 15 (if face assembly 5 is already coupled to fixture body assembly 10), or else simply dropped therein prior to the face assembly's coupling to the top of fixture body assembly 10.

In whatever manner reflective member 20 is placed in position, the resilient bias of flexible reflective member 20 when subjected to such deflection causes member 20 to press against the inner side surfaces 13 and the inside base surface 14 respectively at points A, B, and C, as illustrated in FIG. 4(*a*). Reflective member 20 curvilinearly assumes and maintains the arcuate sectional contour shown. Lateral edges of member 20 abut and are captured between those portions of face assembly 5 extending laterally beyond the inner side surfaces 13 and partially over channel 15 of fixture body assembly 10. Although it may not actually be fastened to any portion of either face assembly 5 or fixture body assembly 10, flexible reflective member 20 remains defectively captured by the surrounding structure.

As shown in FIGS. 4(*a*)–4(*c*), face assembly 5 is formed in the exemplary embodiment shown by a pair of slide-in guides 50 respectively disposed on top surfaces 12 of fixture body assembly 10. Each slide-in guide 50 forms a substantially J-shaped, track-like slot for slideably receiving an edge portion of a face panel member 70. Preferably, at least a portion of each slide-in guide 50 overlaps its corresponding top surface 12 to extend laterally into channel 15 and thereby form an edge stop structure for flexible reflective member 20 deflectively retained within that channel 15.

Each slide-in guide 50 may be formed of any material known in the art suitable for the requirements of the intended application. For example, an extruded plastic material, such as an easily glueable polymeric material, of sufficient strength and rigidity to provide stable support for the given face panel member 70 may be used. Such other materials like cold rolled steel, aluminum, or other sheet metal materials may also be used. In certain embodiments, slide-in guides 50 may simply be formed as an integral part of fixture body assembly 10 itself. In certain other embodiments, protrusive members may be separately formed, apart from slide-in guides 50, to serve the flexible member stopping function.

Preferably, though not necessarily, each slide-in guide 50 in the embodiment shown is adhesively attached to a corresponding top surface 12 for simplicity and economy. Where the requirements of the intended application permit, pressure sensitive tape may be employed for this purpose. In other embodiments, each slide-in guide 50 may be fastened by other suitable means to a top surface 12, or another readily accessible part of fixture body assembly 10.

At least a portion of face panel member 70 defines a light transmissive portion 72 for face assembly 5. This light transmissive portion 72 extends over channel 15 to transmit the light emitted from light source 60 and reflected by the reflective surface of flexible reflective member 20.

While the various components of face assembly 5 are shown to be discretely formed and coupled to fixture body assembly 10, some or all of those components may be formed as integral parts of fixture body assembly 10. As mentioned, for instance, one or both of the slide-in guides 50 and the stop edge portions they form may be realized in alternate embodiments as suitable integrally formed extensions of fixture body assembly 10. Extrusion or other such suitable processes known in the art may be employed to form the integrally combined structures in those alternate embodiments.

Lighting system 1 in the disclosed embodiment further includes a pair of end plates 40 which serve to cap the otherwise openly exposed longitudinal ends of fixture body assembly 10. End plates 40 thereby enclose channel 15. They also serve to respectively support a pair of lamp holders 42 between which a tubular lamp 60 is held to longitudinally extend along channel 15 of fixture body assembly 10. Each end plate 40 preferably supports a lamp holder 42 is affixed thereto by suitable fasteners 41, and is preferably affixed to fixture body assembly 10 by suitably mated fasteners 44 through corresponding holes 43 as shown. Any suitable fastening means known in the art may be employed in these respects. For instance, adhesive or simply a mechanically interlocked engagement may be employed in place of the fastener elements illustrated.

End plates 40 are thus easily removable from fixture body assembly 10 to provide convenient open access to channel 15 and the flexible reflective member 20 retained therein. Such flexible reflective member 20 may be easily removed or replaced by sliding longitudinally outward or inward relative to channel 15. When they are in place, end plates 40 prevent the escape of flexible reflective member 20 which is retained in unfastened, though deflected, manner within channel 15.

End plates 40 may too be formed of any suitable material known in the, art. Examples of such suitable materials include press-formed sheet metal, injection molded plastic, and various other such materials, the specific choice of which is not important to the present invention. Lamp holders 42 supported on end plates 40 may be of any suitable type of ample safety rating commercially available.

The structural configuration of the fixture body assembly 10 components defining channel 15 and the elasticity and thickness of reflective member 20 are such that when reflective member 20 is retained within channel 15, it is deflected to preferably form a quadratically described surface contour. The precise sectional contour imparted to the flexible reflective member 20 may then be determined by appropriately setting these structural and material parameters and freely inserting a normally flat sheet member 20 into the retentive confines of the fixture body assembly's channel 15.

The concave arcuate reflective surface formed by the flexible reflective member's deflection when so confined within this channel 15 may be of any suitable sectional contour required by the intended application. For example, flexible reflective member 20 may be deflected to form a reflective surface having a continuous, semi-circular sectional contour sufficient to cause reflected components of light energy emitted by the tubular light source 60 to constructively intersect one another as they pass through the light transmissive portion 72 of face panel member 70.

The net effect to an observer outside face panel member 70 is an expanded lighting band illuminated about as brightly as the surface of the tubular light source 60 itself, much as described in U.S. Pat. No. 5,509,223. Graphic designs or other indicia formed on the light transmissive portion 72 of face panel member 70 are then be strikingly illuminated and thereby visually enhanced by this bright illumination effect.

Where the structural configuration of the fixture body assembly 10 components defining channel 15 and the elasticity and thickness of reflective member 20 are such that when reflective member 20 is retained within channel 15, it is deflected to alternatively form, for example, a parabolic reflective surface (such as, by varying relative dimensions between points A, B, and C illustrated in FIG. 4(*a*)), the reflected, or virtual image, components emanating from such reflective surface combine with one another in a different manner. Typically, what results at the light transmissive portion 72 in that event is a less uniformly illuminated lighting band having one or more dark areas interposed between bright areas. The light transmissive portion 72 of face panel member 70 may then be provided with a suitable diffusing structure known in the art, such as: convex diamond or convex line pattern formations, a frosted or whitened diffuser face, and the like.

Although this invention has been described in connection with specific forms and embodiments thereof, it will be appreciated that various modifications other than those discussed above may be resorted to without departing from the spirit or scope of the invention. For example, equivalent elements may be substituted for those specifically shown or described, certain features may be used independently of other features, certain features may be formed of components other than those described, and in certain of the process method steps described, particular steps may be reversed or interposed, all without departing from the spirit or scope of the invention as defined in the appended Claims.

What is claimed is:

1. A lighting system comprising:

(a) a fixture body assembly including a longitudinally extended inside base surface and at least a pair of laterally opposed inner side surfaces transversely oriented relative to said inside base surface, said inner side and inside base surfaces defining a longitudinally extended channel;

(b) a face assembly coupled to said fixture body assembly to extend at least partially over said channel thereof, said face assembly including a light transmissive portion;

(c) a flexible reflective member disposed in said channel, said reflective member being defectively retained by said face and fixture body assemblies to define a reflective surface concavely arcuate in sectional contour, a base portion of the reflective surface being supported by said inside base surface of said fixture body; and, (d) a light source disposed adjacent said base portion of said reflective surface, whereby light emitted by said light source is directed in a substantially wide angle illumination pattern through said light transmissive portion of said face assembly.

2. The lighting system as recited in claim 1 wherein said reflective surface defined by said flexible reflective member is substantially semi-circular in sectional contour.

3. The lighting system as recited in claim 1 wherein said face assembly includes at least a pair of slide-in guides disposed on said fixture body assembly for slideably receiving therebetween a face panel member to cover said fixture body assembly channel, said face panel member defining said light transmissive portion.

4. The lighting system as recited in claim 3 wherein said fixture body assembly includes at least a pair of top surfaces extending laterally outward from said inner side surfaces to support said slide-in guides, said slide-in guides overlapping said respective top surfaces to extend into said channel and thereby form edge stops for said flexible reflective member.

5. The lighting system as recited in claim 4 wherein said fixture body assembly is integrally formed, said fixture body assembly including at least a pair of side walls each extending transversely between said inside base surface and one of said top surfaces.

6. The lighting system as recited in claim 5 further comprising at least a pair of end plates coupled to said fixture body assembly to longitudinally enclose said channel thereof.

7. The lighting system as recited in claim 1 wherein said reflective surface defined by said flexible reflective member is substantially parabolic in sectional contour.

8. The lighting system as recited in claim 7 wherein said light transmissive portion of said face assembly having a light diffusing structure formed thereon.

9. The lighting system as recited in claim 8 wherein said face assembly includes at least a pair of slide-in guides disposed on said fixture body assembly for slideably receiving therebetween a face panel member to cover said fixture body assembly channel, said face panel member defining said light transmissive portion.

10. The lighting system as recited in claim 1 wherein said flexible reflective member is releasably retained within said channel in unfastened manner.

11. The lighting system as recited in claim 1 wherein said flexible reflective member is formed of polyester film having a metallic material vapor deposited thereon.

12. A lighting system comprising:

(a) a fixture body assembly including a longitudinally extended inside base surface and at least a pair of laterally opposed inner side surfaces transversely oriented relative to said inside base surface, said inner side and inside base surfaces defining a longitudinally extended channel;

(b) a face assembly coupled to said fixture body assembly to extend at least partially over said channel thereof, said face assembly including a removable face panel member defining a light transmissive portion over said channel of said fixture body;

(c) a flexible reflective member releasably disposed in said channel, said reflective member being defectively retained by said face and fixture body assemblies to define a concave reflective surface substantially semi-circular in sectional contour, a base portion of the reflective surface being supported by said inside base surface of said fixture body; and, (d) a light source disposed adjacent said base portion of said reflective surface, whereby light emitted by said light source is directed in a substantially wide angle illumination pattern through said light transmissive portion of said face assembly.

13. The lighting system as recited in claim 12 wherein said face assembly includes at least a pair of slide-in guides disposed on said fixture body assembly for slideably receiving said face panel member therebetween, each said slide-in guide defining a longitudinally extended slot for slideably receiving an edge of said face panel member.

14. The lighting system as recited in claim 13 wherein said fixture body assembly includes at least a pair of top surfaces extending laterally outward from said inner side surfaces to support said slide-in guides, said slide-in guides overlapping said respective top surfaces to extend into said channel and thereby form edge stops for said flexible reflective member.

15. The lighting system as recited in claim 14 wherein said fixture body assembly is integrally formed, said fixture body assembly including at least a pair of side walls each extending transversely between said inside base surface and one of said top surfaces.

16. The lighting system as recited in claim 15 further comprising at least a pair of end plates coupled to said fixture body assembly to longitudinally enclose said channel thereof.

17. A lighting system comprising:

(a) a fixture body assembly including a longitudinally extended inside base surface and at least a pair of laterally opposed inner side surfaces transversely oriented relative to said inside base surface, said inner side and inside base surfaces defining a longitudinally extended channel;

(b) a face assembly coupled to said fixture body assembly to extend at least partially over said channel thereof, said face assembly including at least a pair of slide-in guides disposed on said fixture body assembly, and a face panel member slideably received therebetween, said face panel member defining a light transmissive portion;

(c) a flexible reflective member disposed in said channel, said reflective member abutting said inside base surface and said inner side surfaces of said fixture body assembly and said slide-in guides of said face assembly to be defectively retained thereby, said flexible reflective member defining a concave reflective surface substantially semi-circular in sectional contour, a base portion of the reflective surface being supported by said inside base surface of said fixture body; and, (d) a light source disposed adjacent said base portion of said reflective surface, whereby light emitted by said light source is directed in a substantially wide angle illumination pattern through said light transmissive portion of said face assembly.

18. The lighting system as recited in claim 17 wherein said fixture body assembly includes at least a pair of top surfaces extending laterally outward from said inner side surfaces to support said slide-in guides, said slide-in guides overlapping said respective top surfaces to extend into said channel and thereby form edge stops for said flexible reflective member.

19. The lighting system as recited in claim 18 wherein said fixture body assembly is integrally formed, said fixture body assembly including at least a pair of side walls each extending transversely between said inside base surface and one of said top surfaces.

20. The lighting system as recited in claim 19 further comprising at least a pair of end plates coupled to said fixture body assembly to longitudinally enclose said channel thereof.

* * * * *